United States Patent [19]

Domeniconi

[11] 4,170,176

[45] Oct. 9, 1979

[54] PRINTING MECHANISM WITH DRIVE FOR AXIALLY MOVABLE DISTRIBUTING ROLLER

[75] Inventor: Marcel Domeniconi, Porrentruy, Switzerland

[73] Assignee: Kurt G. Hinterkopf, Eislingen, Fils, Switzerland

[21] Appl. No.: 832,101

[22] Filed: Sep. 9, 1977

[30] Foreign Application Priority Data

Dec. 23, 1976 [DE] Fed. Rep. of Germany ..... 2658362

[51] Int. Cl.[2] ..... B41F 31/14; B41L 27/16

[52] U.S. Cl. ..... 101/330; 101/349; 101/DIG. 14

[58] Field of Search ..... 101/348, 349, 350, 217, 101/DIG. 14, 205, 206, 207, 208, 209, 38 R, 38 A, 39, 40, 329, 330, 351, 352, 160, 161, 165, 199, 213, 295, 305, 309, 314, 320, 326, 331

[56] References Cited

U.S. PATENT DOCUMENTS

| | | | |
|---|---|---|---|
| 717,239 | 12/1902 | Mellen | 101/DIG. 14 |
| 884,872 | 4/1908 | Sixt et al. | 101/DIG. 14 |
| 1,030,917 | 7/1912 | Osborn | 101/349 |
| 1,733,168 | 10/1929 | Pritchard | 101/350 |
| 2,406,928 | 9/1946 | Taylor et al. | 101/350 |
| 3,452,673 | 7/1969 | Gegenheiner et al. | 101/349 |
| 3,815,498 | 6/1974 | Harrod | 101/DIG. 14 |

FOREIGN PATENT DOCUMENTS

| | | | |
|---|---|---|---|
| 2144636 | 3/1973 | Fed. Rep. of Germany | 101/349 |
| 2238481 | 2/1974 | Fed. Rep. of Germany | 101/349 |

*Primary Examiner*—J. Reed Fisher

*Attorney, Agent, or Firm*—Blanchard, Flynn, Thiel, Boutell & Tanis

[57] ABSTRACT

A device for controlling the movement of hollow workpieces in, for example, a printing mechanism environment. Cam surfaces are locked to the interior of the hollow work performing member. A spindle is provided having secured thereto cam rollers operatively connected to the cam surfaces. The cam surfaces are identical in shape and are oriented so that a movement of the cam rollers relative thereto will effect an axial shifting of the hollow work member relative to the spindle. The spindle is driven for rotation by a first drive mechanism. The hollow work member is driven for rotation by a second drive mechanism which can be, in the printing machine environment, a frictional force applied by other driven rollers in the system. When the rotational speed of the spindle is in excess of the rotational speed of the hollow work member, the cam rollers wil move relative to the cam surfaces and effect the aforesaid axial shifting. The same operation will occur when the rotational speed of the spindle is less than the rotational speed of the hollow work member. As a result, color which is applied to the hollow work member will be evenly applied due to the aforesaid axial movement. In addition, the amount of axial movement can be accurately controlled by controlling the rotational speed of the spindle and the hollow work member.

6 Claims, 4 Drawing Figures

PRINTING MECHANISM WITH DRIVE FOR AXIALLY MOVABLE DISTRIBUTING ROLLER

FIELD OF THE INVENTION

The invention relates to a machine for controlling of hollow workpieces, for example tubes, in a continuous flow, comprising a printing mechanism, which has a doctor roller, a distributing roller which can be moved axially back and forth and which cooperates with another roller for the color distribution, a press roller and a printing roller and, if desired, further intermediate rollers.

BACKGROUND OF THE INVENTION

In known machines of this type, the drive of all rollers is taken from one single general drive for the printing mechanism, namely from the drive of the printing rollers. This drive must be converted many ways for the individual rollers. For example, the distributing roller must not only be driven rotatingly with a certain peripheral speed, but it must also be axially movable back and forth, in order to achieve an application of color which is as even as possible over the entire width and periphery therof. The axial movement of the distributing roller relative to the roller which cooperates with it is achieved in conventional machines by a cross thread on the drive spindle, wherein the reversal of the direction of movement occurs automatically at the end of the respective stroke through a fork. One must thereby accept, due to the clearances, that at the end of each stroke, thus at the reversal point, a short standstill of the drive spindle in the direction of movement will occur. This has a disadvantage effect on the even distribution of the color. Since the fork applies a certain amount of friction on the distributing roller, it may be that the distributing roller starts to slide in particular during starting, thus does not start correctly and the rated speed is reached anyhow only very slowly. The center removal of this movement from the main drive, in addition, makes it impossible to influence the distributing speed in any manner. This would be advantageous, however, in the case of some colors.

Also the drive for the doctor roller cannot directly be taken from the main drive, but it too must be converted, namely either into a continuous drive at a different peripheral speed or into a gradual drive with constant intervals. Here too exists the disadvantage that the rotational speed of the doctor roller cannot be adjusted to changing conditions, as for example the viscosity of the color, the desired operating speed, the prevailing temperature, etc.

Therefore, a purpose of the present invention is to produce a machine of the abovementioned type in which the important rollers, as for example the distributing roller and/or the doctor roller, can be controlled or influenced in a simple manner and continuously or steplessly in their movements, so that they can be adjusted to different conditions.

The invention provides that the axially movably supported, preferably hollow-cylindrical shell of the distributing roller is fixedly connected with respect to rotation to at least one axially directed curved surface, wherein a pin which is fixedly connected with respect to rotation to a spindle, which spindle is axially nonmovable and is arranged preferably coaxially with respect to the shell, rests on the curved surface, and wherein the shell and the spindle can be driven independently from one another.

Thus the distributing speed between the distributing roller and the respective abutting roller can be controlled and influenced in a simple manner such that the speed of the distributing shell and the drive spindle is different. The larger the speed difference, the higher is the axial distributing speed. However, if the speeds are the same, then the shell of the distributing roller does not carry out any back and forth movement. By controlling one of the rotational speeds, for example the one of the drive spindle, a very fine stepless or continuous control of the distributing speed can take place. Generally, the distributing shell is driven through other abutting rollers, while the spindle has a separate controllable drive. Since both parts of the distributing roller are driven, a safe starting is also assured and a slipping through or a slowing down due to the friction is impossible because the axial drive occurs substantially in an interlocked manner.

BRIEF DESCRIPTION OF THE DRAWINGS

Further details and developments of the invention can be taken from the following description, in which the invention is described and discussed with reference to the exemplary embodiment illustrated in the drawings, in which.

DETAILED DESCRIPTION

Figure 1:
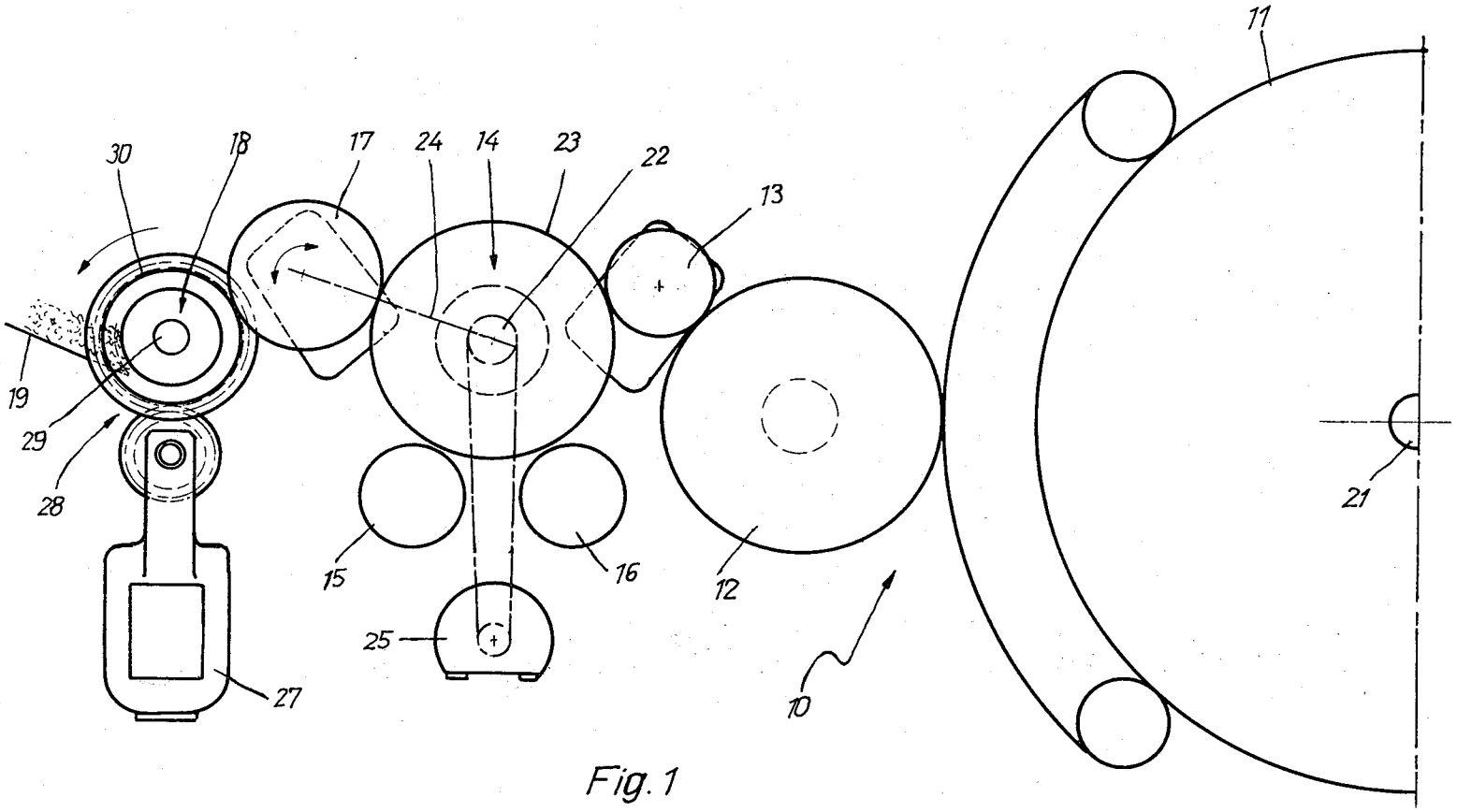
FIG. 1 schematically illustrates the roller organization of the printing mechanism in a machine for treating of hollow workpieces, according to one exemplary embodiment of the present invention.

In the inventive machine for treating of hollow workpieces, as in particular tubes, however, also shells, pipes or the like, in a continuous flow, FIG. 1 substantially illustrates only the part, which contains the printing mechanism 10. The printing mechanism 10 has in the illustrated exemplary embodiment a printing roller 11, a press roller 12, which cooperates with the printing roller 11 and carries a not illustrated printing plate which is mounted on its periphery, a transfer roller 13, a center distributing roller 14, on which is engaged mirror rollers 15 and 16, a ductor roller 17, which moves back and forth between the distributing roller 14 and a doctor roller 18 for the color transmission. The doctor roller 18 receives its color through a doctor 19 from a color box 20 (FIG. 2) which is connected to a storage container (not illustrated). The color travels from the doctor roller 18 over the distributing roller 14 to a ductor roller 17 by which it is distributed over the transfer roller 13 to the press roller 12, from the printing plate of which it is transmitted onto the printing roller 11.

The printing mechanism has a main drive mechanism (not illustrated), which is operatively connected to the shaft 21 of the printing roller 11 and is removable therefrom through for example a gear drive (not illustrated) for operative connection to the press roller 12. The press roller 12 is in a frictional-resistance driving connection with the transfer roller 13 and the shell 23 of the distributing roller 14. The ductor roller 17 is driven by a not illustrated belt drive from the shaft of the press roller 12. Aside from a rotational movement, the ductor roller 17, in addition, performs a swivelling or pivotal movement by means of an arm 24 which is pivotal for example about the axis of the spindle 22 supporting the distributing roller 14. The spindle 22, which is coaxial with respect to the shell 23 and is rotatable relative thereto, is connected to, for example through a belt drive, a separate, steplessly controllable drive motor 25. While the spindle 22 of the distributing roller 14 is held rigidly in a frame of the printing mechanism 10, it is possible, as will be described below, to move the shell 23 of the distributing roller 14 back and forth in longitudinal direction of the spindle 22 for distributing the color between itself and for example the transfer roller 13.

Figures 2, 4:
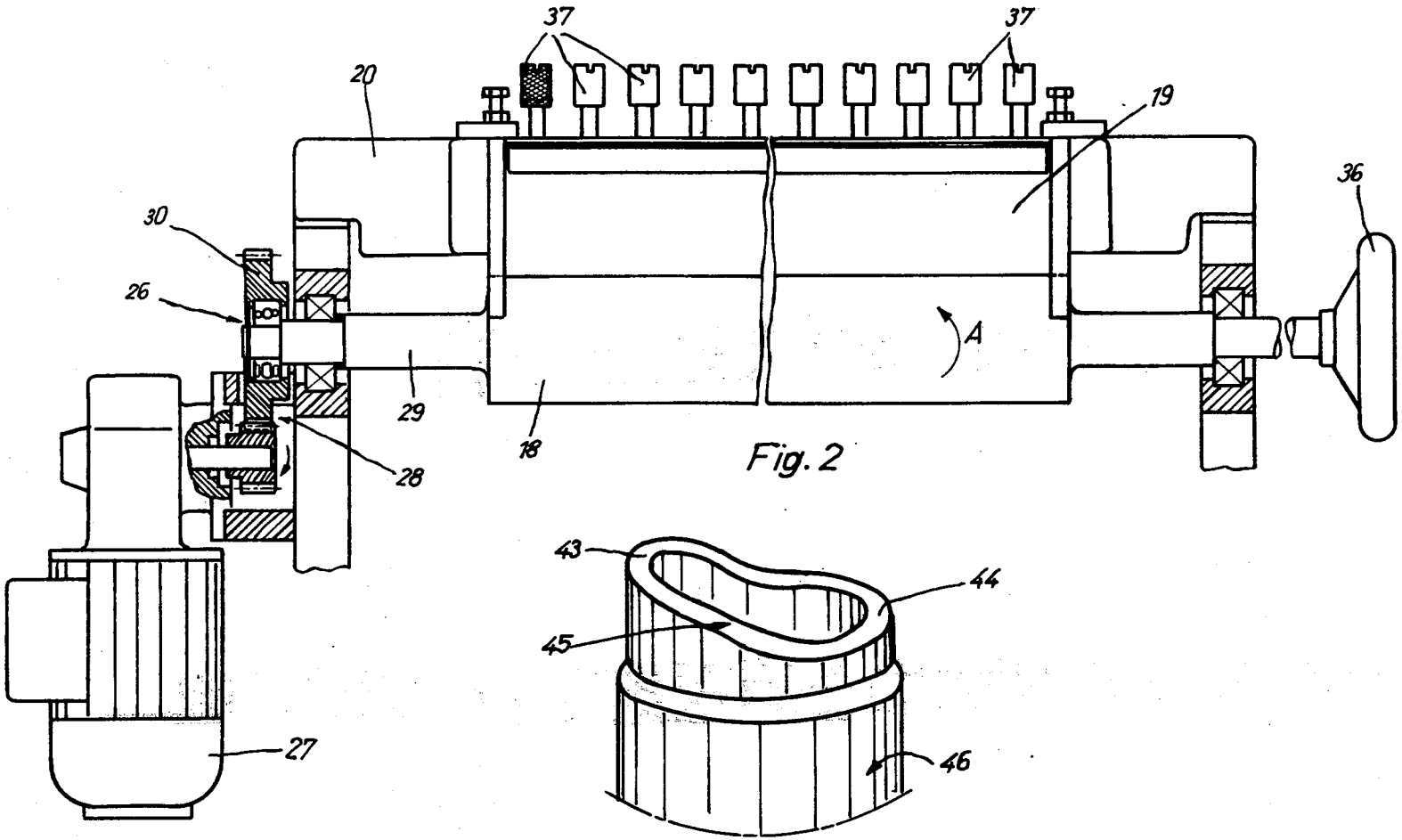
FIG. 2 is a side elevational view of a doctor roller having its own drive mechanism.
FIG. 4 is a perspective view of a sleeve which is used in the distributing roller and which defines a control cam.

As is illustrated in FIGS. 1 and 2, the doctor roller 18 is also connected to a separate geared motor 27 which can drive the doctor roller 18 continuously or step-by-step, so that it can be independently rotatably driven from both a main drive mechanism and also from the drive of the spindle 22 of the distributing roller 14. The geared motor 27 is connected to the drive spindle 29 of the doctor roller 18 through an angle gear arrangement, a gear drive arrangement 28 consisting of two gears and a freewheeling clutch 26. The freewheeling clutch 26 may be of the usual and conventional type of construction and therefore does not need to be described in detail. It can be provided at a suitable point in the gear drive arrangement 28. The freewheeling clutch 26 is in the exemplary embodiment arranged between the drive spindle 29 and the gear 30 of the gear drive arrangement 28 mounted on the drive spindle 29 (FIG. 2). The freewheeling clutch, which is arranged with the gear 30, effects a rotationally fixed connection in one direction of rotation A between the spindle and the gear when the gear 30 is driven faster by the geared motor 27 than the spindle 29 is rotating. Thus the spindle 29 is taken along by the gear 30, so that the doctor roller 18 rotates with the speed determined by the motor 27 and the gearing 28. This clamping drive connection is cancelled in the spindle 29 is rotated faster in the same direction of rotation A than the gear 30. Thus it is possible, on the one hand, because of the separate drive 27 to adjust said drive and thus the rotary movement of the doctor roller 18 to given outer influences, namely for example to characteristics of the applied media, and, on the other hand, because of the freewheeling clutch 26 a movement of the doctor roller 18 can be permitted which is faster than the drive 27. This means that the doctor roller 18 can, for example for increasing the color supply, be driven faster by means of a hand wheel 36 positioned fixed with respect to rotation on the drive spindle 29 on the end thereof remote from the gear drive 28. Both ends of the spindle 29 are rotatably supported. The doctor roller 18 which is thus not rigidly connected to the drive 27 in one direction of rotation can through this aforedescribed structure be rotated also for example during standstill relative to its drive, which is advantageous for servicing measures. In addition, and as is illustrated in FIG. 2, the color box 20 is arranged above the doctor roller 18 and projects laterally beyond both sides and is supported on the doctor 19 which can be adjusted by means of setscrews 37 relative to the doctor roller 18.

As mentioned, the shell 23 of the distributing roller 14 and the intermediate or transfer roller 13 which is constructed as a rubber roller roll frictionally engage one another. In the exemplary embodiment, the transfer roller 13 is driven through the press roller 12 while the distributing roller shell 23 is taken along by friction to effect a long duration transmission. The distributing roller shell 23, however, also carries out an axial movement relative to the rigidly arranged transfer roller 13 and causes a distributing and thus an even application or transfer of the color over the entire length and the entire periphery of the transfer roller 13.

To carry out this axial distributing movement, the shell 23 which for example consists of steel and which is provided with a copper or hard-rubber coating is supported axially movable relative to the independently driven spindle 22. The axial movement of the shell 23 relative to the spindle 22 occurs, as will be discussed below, through a difference in the rotational speed of the two elements. Both the shell 23 and also the spindle 22 are thereby driven in direction of the arrow B or in an opposite direction, at any rate, however, in the same direction of rotation at a speed $n_m$ or $n_s$. While the speed $n_m$ of the shell 23, the drive of which is taken from the main drive of the printing mechanism 10, is constant, the peripheral speed of the spindle 22 can be controlled substantially steplessly by means of the drive motor 25, such that its rotational speed $n_s$ can be made higher, equal to or lower than the speed $n_m$ of the shell 23.

Figure 3:
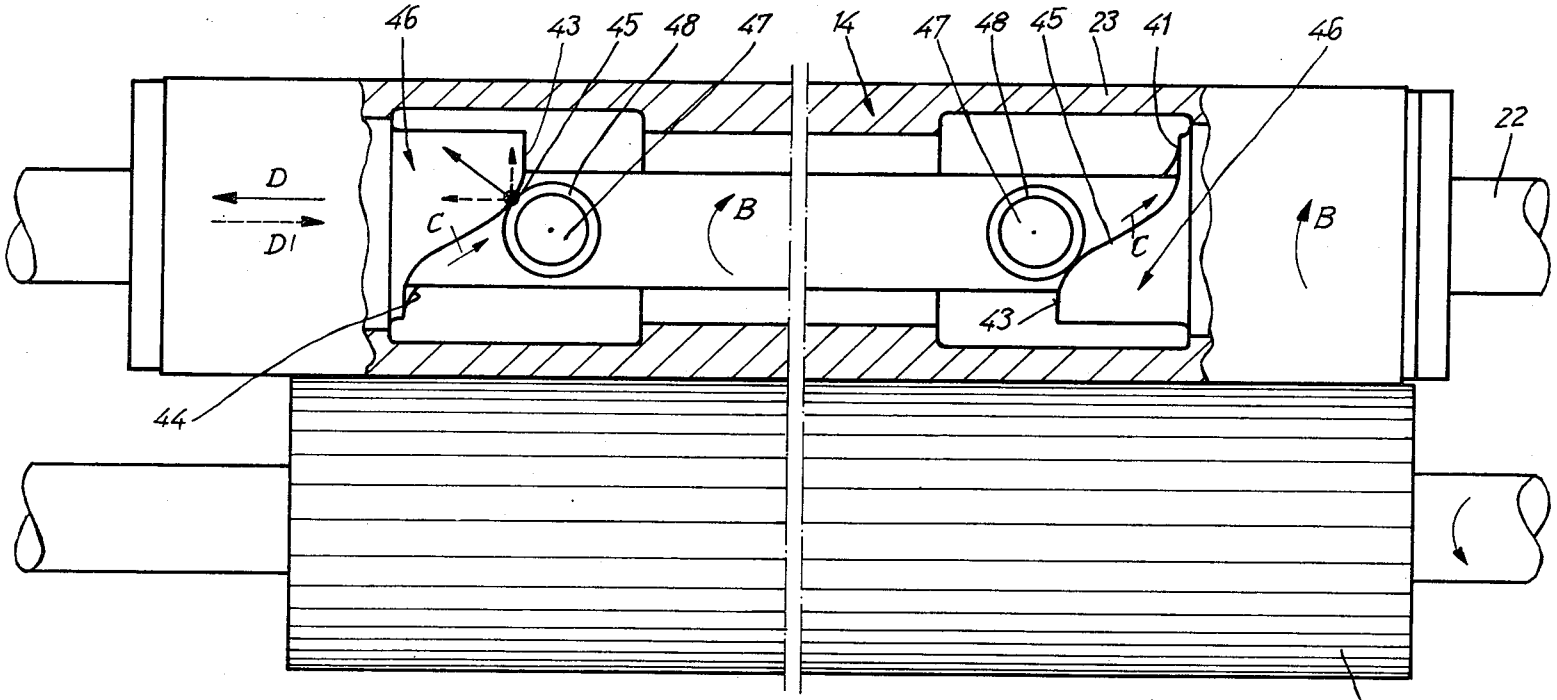
FIG. 3 is a side elevational view, partially in section, of the distributing roller which engages a further roller.

As is illustrated in FIG. 3, a sleeve 46 is received in both ends of the hollow shell 23, the outer circumferences of which correspond approximately to the inner circumference of the roller shell 23 and which are secured to the face of the roller shell 23. The identical sleeves 46 have an axial opening therein into which the spindle 22 is rotatably supported. The sleeves 46 which are fixedly connected to and rotatable with the roller shell 23 each have an axially facing curved surface 45 at their inwardly facing ends, the qualitative path of said curved surfaces being generally illustrated in FIG. 4 in connection with one of the sleeves. The curved surface 45 of the one sleeve 46 is identical with the curved surface on the other one and they are equally directed and have a parallel course in the installed positions of the sleeves 46, so that they fit on one another without any rotation during assembly. A pair of cam rollers 48 which are each rotatably supported on one end of a pair of pins 47 and engage with their outer periphery the curved surface 45 are provided. The other end of each of the pins 47 is screwed into a radially extending threaded opening in the spindle 22. The two pins 47 and therewith also the cam rollers 48 are in alignment viewed axially in the illustrated exemplary embodiment, namely they are not offset to one another over the periphery of the spindle 22. The curved surfaces 45 have a continuous path which extends 360° and a constant incline so that the speed of axial movement of the roller shell 23 is derived therefrom and is generally at a speed which is a constant difference in rotational speed between $n_m$ and $n_s$. The transition from the positive to the negative rise or vice versa and thus the reversal of the movement at the high point 43 or at the low point 44 of the curved surface 45 will ocur gradually or quickly. This is dependent, however, from the construction of the curved surface 45.

It is understood that the curved surfaces of the two opposed sleeves can also be positioned to face in opposite directions. It is also possible to offset the curved surfaces and thus also the pins which have the cam rollers thereon at, for example, 180° with respect to one another. It is, in addition, possible to provide the curved surfaces with a path which changes unevenly or irregularly.

If the shell 23 and the spindle 22 of the distributing roller 14 are driven in direction of the arrow B such that the speed $n_s$ of the spindle 22 equals the speed $n_m$ of the shell 23, then an axial movement of the shell will not occur with respect to the axially stationary spindle because the pins 47 will remain in the position illustrated in FIG. 3 relative to the curved surfaces. If, however, the spindle 22 is driven faster than the shell 23, then the pins which are fixedly connected to and rotatable with the spindle 22 move on the curved surface 45 in direction of the arrow C. The pin 47, which is the left one in FIG. 3 and which is moving from the low point 44 to the high point 43 of the cam surface, causes the roller shell 23 to be moved to the left in direction of the arrow D until the cam roller reaches the high point 43 of this curved surface 46. This is the maximum amount of movement of the shell 23 relative to the spindle 22; during this movement the pin 47 which is the right one according to FIG. 3 will have moved toward the low point 44 of the right curved surface 46 in direction of the arrow C. Upon further rotation the right pin 47 will cause the shell 23 to be moved back in the opposite direction, thus in direction of the arrow D' for the same amount. The speed of this back and forth axial movement D-D' of the shell 23 relative to the spindle 22 depends on the magnitude of the difference in the respective speeds of the shell and spindle.

FIG. 3 shows furthermore the force vectors which occur during this movement, of which the radial power components support the rotation of the shell 23 occurring through friction with the rubber transfer roller 13. The axial power component produces the back and forth going movement of the shell 23. The resulting force which results from these two power components is also illustrated.

The same movement will also occur when the speed $n_s$ of the spindle 22 is less than the speed $n_m$ of the shell 23, but then not the pins 47, but the curved surfaces 45 of the sleeves 46 are the active, faster rotating parts, because in the first case, in which the spindle 22 rotates faster, the pins 47 or the cam rollers 48 urge the sleeves 46 into the corresponding direction, while in the other case the sleeves 46 are supported on the cam rollers 48.

In both cases, with a certain curved surface 45, the speed of the axial relative movement of the shell 23 is proportional to the magnitude of the difference in the rotational speeds between the spindle 22 and the shell 23. It is to be understood that the low point 44 and the high point 43 of the curved surfaces 45 can axially also be farther apart, so that a larger axial travel for the roller shell 23 relative to the spindle 22 will be obtained. In addition, it is also possible to space apart or circumferentially offset the high point 43 and the low point 44 of the curved surface 45, instead of 180°, to a different angular spacing, so that the axial relative movement occurs quicker in one direction than in the other; also it is possible for the curved surface parts which lie between the high point and the low point to extend differently. The two curved surfaces 45, as a whole, are, however, with respect to the inclined and any other path at all times identical. Since the sleeves 46 are preferably maintained exchangeably in the shell 23, it is possible to choose a different axial distributing movement on the sleeves corresponding with the requirements by means of different curved surfaces.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A printing mechanism having a doctor roller, a distributing roller which can be moved axially back and forth and which cooperates with another roller for the color distribution, a press roller and a printing roller, the improvement comprising wherein said axially movably supported distributing roller has a hollow-cylindrical shell, an axially fixed spindle supporting said cylindrical shell for rotation and axial movement relative thereto, and at least one axially facing curved surface fixedly connected to said cylindrical shell and rotatable therewith relative to said spindle, wherein a pin is fixedly connected to said spindle and is rotatable therewith, said pin engaging said curved surface, said spindle extending generally coaxially of said cylindrical shell, and wherein first drive means effect a drive of said cylindrical shell and wherein second variable speed drive means effect a drive of said spindle, said first and second drive means being independent of one another so that variations in the driven speed of said second drive means relative to the speed of said first drive means will effect a variation in speed of the axial movement of said cylindrical shell including a zero amount of axial movement.

2. The improved machine according to claim 1, wherein two identical axially facing and axially spaced curved surfaces are provided on said cylindrical shell, and wherein said spindle has a pair of pins thereon each engaging one of said curved surfaces, said curved surfaces being 180° offset to the other.

3. The improved machine according to claim 2, wherein each pin projects radially of said spindle, and is arranged 180° offset with respect to the other.

4. The improved machine according to claim 1, wherein the curved surface extends steplessly over 360° and wherein the contour of said curved surface extends axially of said spindle.

5. The improved machine according to claim 1 wherein said pin is screwed into said spindle and has a roller bearing on its end which engages said curved surface.

6. The improved machine according to claim 1, wherein said curved surface is provided on a sleeve which is arranged between said cylindrical shell and said spindle and is exchangeably fixedly connected to said cylindrical shell.

* * * * *